US005250755A

United States Patent [19]

Dinzen et al.

[11] Patent Number: 5,250,755

[45] Date of Patent: Oct. 5, 1993

[54] X-RAY CONDUITS

[75] Inventors: Helmut Dinzen, Koln; Peter Funken, Frechen, both of Fed. Rep. of Germany

[73] Assignee: Felten & Guilleaume, Köln, Fed. Rep. of Germany

[21] Appl. No.: 828,216

[22] Filed: Jan. 30, 1992

[30] Foreign Application Priority Data

Jan. 30, 1991 [DE] Fed. Rep. of Germany ..... 4102698
Nov. 27, 1991 [DE] Fed. Rep. of Germany ..... 4138889

[51] Int. Cl.[5] ..... H01B 7/34; H01B 11/18

[52] U.S. Cl. ..... 174/102 SC; 174/106 SC; 174/113 R; 174/113 C; 174/126.2

[58] Field of Search ..... 174/102 SC, 106 R, 106 SC, 174/126.2, 128.1, 128.2, 113 C, 113 R

[56] References Cited

U.S. PATENT DOCUMENTS 2,081,517 5/1937 Van Hoffen ..... 174/106 SC
2,918,722 12/1959 Kenmore ..... 174/126.2
3,187,071 6/1965 Radziejowski ..... 174/102 SC
3,275,739 9/1966 Eager, Jr. ..... 174/106 R
3,829,707 8/1974 Pflanz ..... 174/126.2 X
4,486,721 12/1984 Cornelius et al. ..... 174/106 R X
4,691,082 9/1987 Flatz et al. ..... 174/106 SC
5,068,497 11/1991 Krieger ..... 174/106 R

FOREIGN PATENT DOCUMENTS 1614075 8/1970 Fed. Rep. of Germany ..... 174/102 SC

*Primary Examiner*—Morris H. Nimmo
*Attorney, Agent, or Firm*—Michael J. Striker

[57] ABSTRACT

An X-ray cable has a plurality of elements arranged concentrically relative to one another and including from inside toward outside at least one inner conductor, an inner conducting sleeve, a high voltage isolation, an outer conducting sleeve, a screen and a casing. The inner conductor is composed of one or several wires with a thickness between 0.1 and 0.6 mm. At least one of the wires is composed of ferromagnetic material with high permeability at frequencies over 1 MHz, and a direct current resistance of the inner conductor lies under 20 Ω/m, so that without the use of damping members with a frequency above 1 MHz strongly increasing damping of occurring transient over voltages is provided.

21 Claims, 3 Drawing Sheets

FIG. 1a
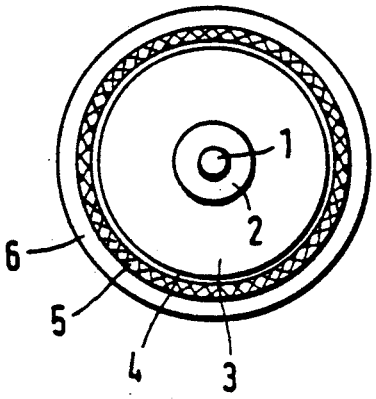
FIG. 2a
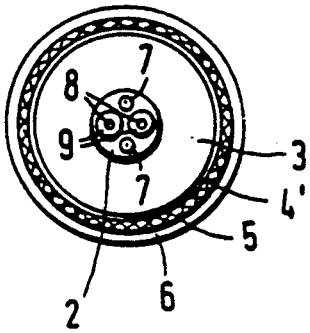
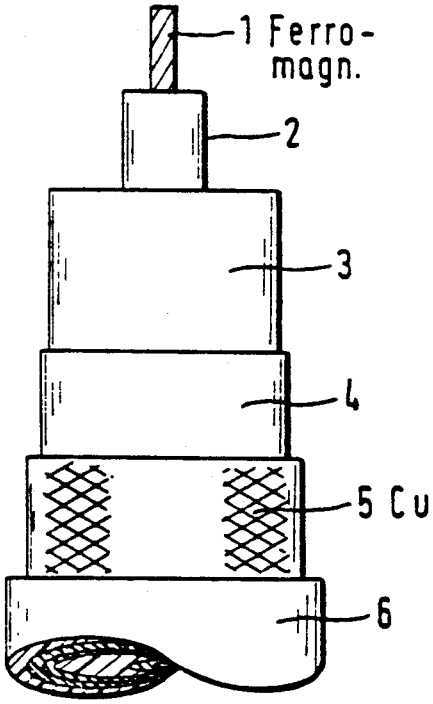
FIG. 1b
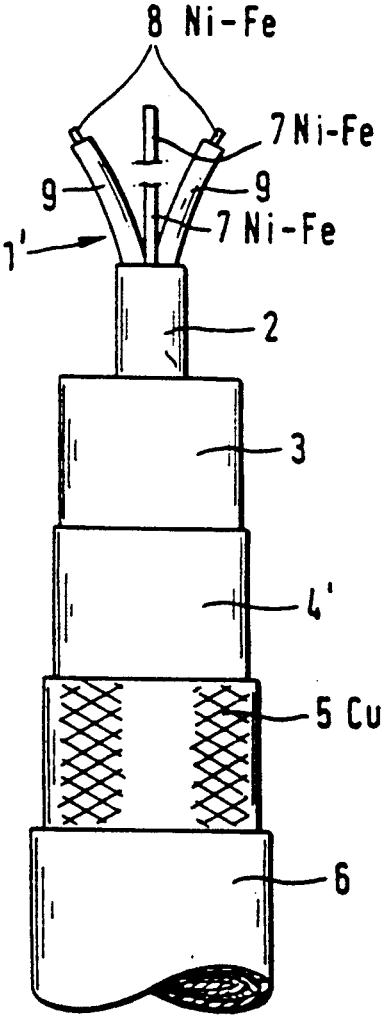
FIG. 2b

X-RAY CONDUITS

BACKGROUND OF THE INVENTION

The present invention relates to an X-ray cable, more detailed an electric cable for supplying a X-ray tube. More particularly it relates to an X-ray conduit which has an inner conductor or a cable core with several inner conductors, an inner conducting sleeve, a high voltage insulation, an outer conducting sleeve, a screen and a casing. Its purpose is to make the transient overvoltages eventually carried during the X-ray operation as not damaging.

The above specified construction of the X-ray conductor is known in the art and is disclosed for example in the German Patent 972,701. As specified hereinabove, it includes, in addition to the high voltage conductor, the inner conducting layer formed as a conducting sleeve, a high voltage insulation, and an outer conducting layer, and, a screen arranged over them and formed for example as a concentric outer cable, and finally a casing. In the course of time the cable core or the inner conductor arrangement have been subjected to different developments, while to the contrary the remaining cable structure remains the same. The conventional conductor arrangements which are used now usually include the following. In the core of the X-ray cable, in addition to the bare high voltage conductor there are two insulated heating conductors, while the round, fine- wire high voltage conductor is subdivided for symmetry into two round, half conductors so that in the cable core there are four elements stranded with one another (F&G Prospectus "Elektrotechnik" 12.72, page 23).

In the core of the X-ray cable the both insulated heating conductors are stranded with an isolated grid-driving conductor, a conductive sheathing is located on it, and then the concentric high voltage conductor is stranded (DE-GM 8,526,448).

The concentric construction is provided in that the heating conductor 1, the insulation, the heating conductor 2, the insulation, the high voltage conductor are concentrically braided (F&G Prospectus, "X-Ray Conductors" 04.89). In all cases the following construction is accepted: the inner conducting layer, the high voltage insulation, the outer conducting layer, the screen and the casing.

For the inner conductor, a strand of thin, zinced copper wires is used, which can be reinforced in its core by zinc steel wires for pulling resistance. For the conducting sleeves, semiconductor rubber or synthetic plastic mixtures (compounds) bands or foils are used. For the high voltage, cross-linked rubber or synthetic plastic mixtures are used, such as elastomers, for example EPR. For the outer conductor, a strand or a braid of copper wires is used. For the casing, rubber or synthetic plastic mixture such as PVC or glass yarn braid are used.

During the X-ray operation electrical unloading or short-circuiting can occur in the X-ray tubes. As a result, transient over voltages or wandering waves occur and are withdrawn through the X-ray conduit. This high frequency over voltages can lead to damages and disruption of electronic devices and structural elements located close to the disturbance source, such as X-ray tube or cable. For avoiding such disturbances, it is known to electrically screen the disturbance source and to reduce or suppress the propagation of the transient over voltages through the X-ray conduit by damping members.

As for the screening, the German document DE-A-1,540,332 discloses a cable sheathing for screening electromagnetic disturbance signals. Here between the cable cord and the casing, there are two braids with wires in one braid composed of pure iron and wires in the other braid composed of iron-nickel alloy with relatively high permeability. The first mentioned braid faces the respective incoming or outgoing disturbance source. The purpose of such a screening is to suppress disturbance signals for the whole electromagnetic spectrum from direct current to the microwave frequencies. As for the cable, it is always stated that it is composed of one group of wires or cables, the screening provides a damping of disturbance signals in a transverse but not in a longitudinal direction of the cable, and the problems of the transient over voltages occuring in the X-ray conduits still are not eliminated.

For solving these problems in the X-ray cable, sensing members switched in the conductor circuit are proposed in different shapes and arrangements. For example the German document DE-A-2,010,143 discloses high voltage cable for an X-ray tube in which a damping resistance is vulcanized in the high voltage plug, which connects the cable with the tube. The resistance can be formed as ohmic resistance (resistance wire), an inductive resistance (conductor coil on a core of greater magnetic permeability), or a combination of both. The German document DE-A1-3,929,402 discloses an X-ray device in which a high frequency-operating damping impedance is arranged in the high voltage cable or in the output of the high voltage generator. In the first arrangement it is composed of a ferrite core which surrounds the cable as a hollow cylinder while in the second arrangement it is composed of a resistance (diode or condensor) which is connected in parallel to the output of the generator. On the one hand this approach requires an additional damping member with significant expenses, and on the other hand its efficiency is to be improved.

SUMMARY OF THE INVENTION

Accordingly, it is an object of the present invention to provide an X-ray cable in which the propagation of the transient over voltages through the X-ray cable is substantially reduced.

In keeping with these objects and with others which will become apparent hereinafter, one feature of the present invention resides, briefly stated, in an X-ray cable in which without the use of damping members, at the frequency of above 1 MHz a strongly increasing damping of the occurring transient over voltages is provided.

For this purpose each inner conductor is composed of several wires with a thickness between 0.1 and 0.4 mm, or of a wire with a thickness between 0.2 and 0.6 mm, while each or at least one wire is composed of a ferromagnetic material, for example iron or a nickel-iron alloy with high permeability at frequencies over 1 MHz and in some cases the remaining wires are composed of a material with high electrical conductivity. The multiplication factor of the damping value with reference to 1 kHz lies with the use of wires of a nickel-iron alloy at 3 MHz over 190 and at 6 MHz over 300, and the direct current resistance of each inner conductor lies under 20 Ω/m.

It is advantageous to use a nickel-iron alloy with a composition of 75% Ni, 5% Cu, 2% Cr, 0.5% Mn, 0.2% Si, 0.02% C with iron as the rest which is known in trade under the name "MAGNIFER ®75". In order not to exceed with the inner conductor the limiting value of the direct current resistance, the core wire or the smaller part of the wires is composed of copper, in rare cases of silver, and the remaining wires are composed of iron or the Ni-Fe-alloy.

The advantage obtained by the inventive X-ray cable is especially that, it is no longer necessary to use damping members which were required for over voltage protection in the existing X-ray devices, and as a result space and costs are saved in the devices.

The present invention utilizes the theory of the electrical cables as follows. A cable through which alternating current flows can be defined in the following values: resistance, inductivity, capacity and conductance (dielectric losses). With respect to a cable portion, a corresponding value per unit length is to be referred to. Inductivity per unit length L' and capacitance per unit length C' are less frequency dependent, while resistance per unit length R' (skineffect) and conductance per unit length G' are more frequency dependent.

The damping per unit length $\alpha$ depends on how high is the relative decrease of the effective values (of voltage and current in a propagating wave)with respect to the cable length. The damping is caused by the energy losses in the cable, which are produced partially in the cable wires and partially in the isolation. For with the circular frequency $\omega=2\pi f$ the following approximation situation can be obtained: For sufficiently low frequencies $$\alpha=(\tfrac{1}{2}\omega C'R')^{\frac{1}{2}} \quad (1)$$

and for higher frequencies $$\alpha=R'/2(C'L')^{\frac{1}{2}}+G'/2(L'/C')^{\frac{1}{2}} \quad (2)$$

It can be seen that the damping per unit length grows faster at sufficiently low frequencies (see equation (1)) than at higher frequencies (see equation (2)). With higher frequencies it grows due to the skin effect and conductance damping. In the normal conduits the conductance damping is small with respect to the resistance damping. An increase of the inductivity in accordance with equation (2) reduces the resistance damping and increases the conductance damping, and also reduces the total damping, as long as the resistance damping is greater than the conductance damping. Reference can be made to Küpfmüller "Einführung in die theoretische Elektrotechnik" Springer-Verlag 1984 page 404/10/15.

The inductivity of the X-ray cable is determined by the permeability of the utilized conductor materials. The skin effect which deals with the current displacement in a cylindrical conductor, causes a growth of the resistance with the frequency and the permeability. For very high frequencies $R=\omega L$ is obtained.

While in the cables for transmitting high frequency data and signals a lowest possible damping is required, to the contrary in the X-ray cables in the frequency region over 1 MHz a significant damping is needed to make the occurring transient over voltages not damaging.

The invention presents two examples explained in the specification and shown in the drawings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1*a* and 1*b* are a side view and a plan view showing a 110 kV X-ray cable, more precisely a 110 kV cable for supplying a X-ray tube, with an inner conductor and a concentric outer conductor. In this case the heating conductor is separately guided from the high voltage cable; FIGS. 2*a* and 2*b* are a side view and a plan view showing a 75 kV X-ray cable with four inner conductors (two high voltage conductors and two heating conductors) in a conductor core, and both cables of FIG. 1 and 2 are formed for damping transient over voltages;

FIGS. 5 and 6 show further embodiments of the X-ray cable in accordance with the present invention.

DESCRIPTION OF THE PREFERRED EMBODIMENTS

Figure 3A:
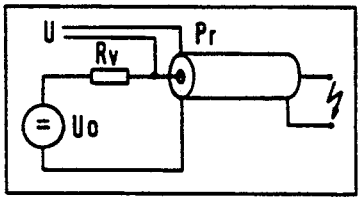
FIG. 3 shows a time decay of the transient over voltage $U_\phi$ (in ratio to the applied voltage $U_\phi$) in the event of a short circuit.

A 110 kV X-ray cable shown in FIG. 1 has the following construction. In accordance with the present invention an inner conductor 1 of example A has a core in form of a synthetic plastic string and around it a layer of 6 stranding elements each including a core wire and a layer of 6 wires. All 42 wires are steel wires with a thickness of 0.15 mm and they are stranded to form a cord. In accordance with the example B the inner conductor 1 has a core including a copper wire with a thickness of 0.2 mm, and around it a layer of 6 nickel-iron alloy wires with a thickness of 0.2 mm. As conventional the inner conductor is concentrically surrounded by an inner conducting sleeve 2 of semi-conducting rubber with the diameter of 5 mm, a high voltage insulation 3 of EPR (ethylene-propylene rubber) with a diameter of 15 mm, an outer conducting sleeve 4 of semiconducting rubber, an outer conductor 5 of braided copper wires with 95% covering, and an outer casing 6 of PVC with a diameter of 19 mm.

A 75 kV X-ray cable shown in FIG. 2 has the following construction. In accordance with the invention a cable core 1' has two bare high voltage conductors 7 of Ni-Fe-alloy wires and two insulated heating conductors 8 of Ni-Fe-alloy wires with a conductor insulation 9 of TEFZEL. The high voltage conductors 7 and the heating conductors 8–9 are stranded with one another to form a cable core. As conventional, the inner conducting sleeve 2 is composed of semi-conducting rubber, the high voltage insulation 3 is composed of ethylene-propylene rubber, the outer conductive sleeve 4' is composed of a semi-conducting coated band, the screen braid 5 is composed of copper wires, and the outer casing 6 is composed of PVC.

As in the above mentioned prior art, there are several different constructions for the cable core. The remaining structure of the X-ray conduit (high voltage isolation, screen and casing) is the same. In all cases in accordance with the present invention, all conductors of the cable core (inner conductors) are formed as braids or strands of ferromagnetic wires or in combination with copper wires, rarer with silver wires.

Figure 3B:
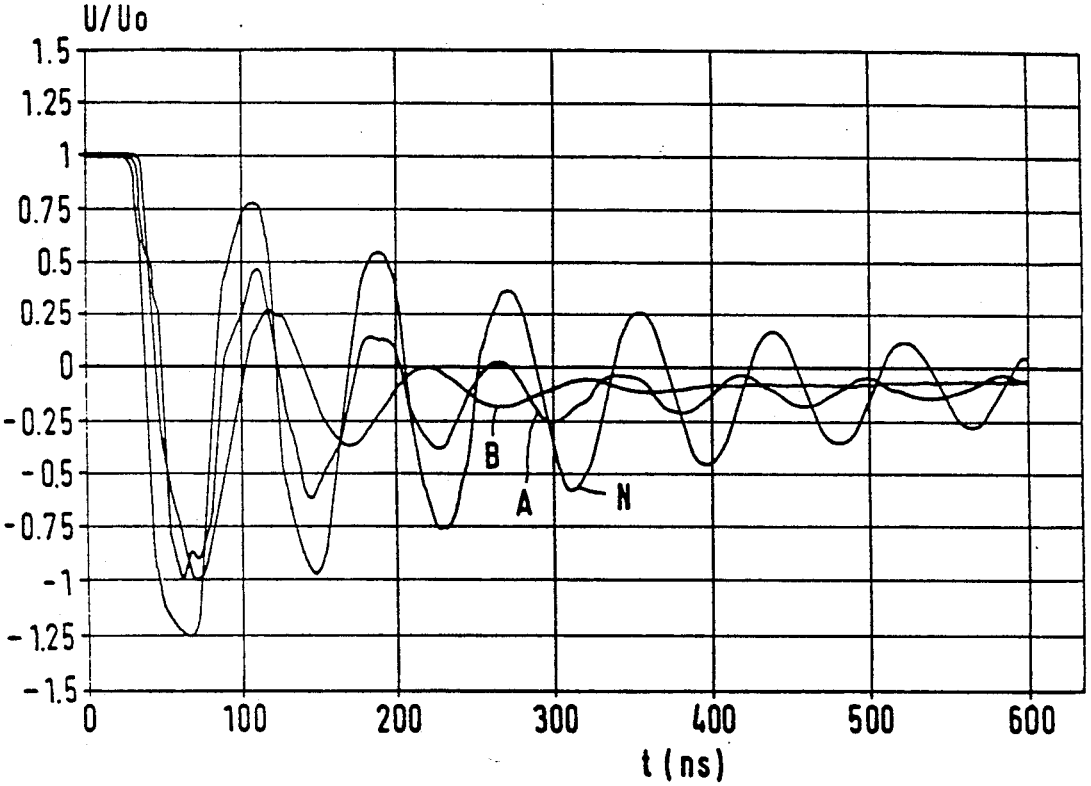
Figure 4:
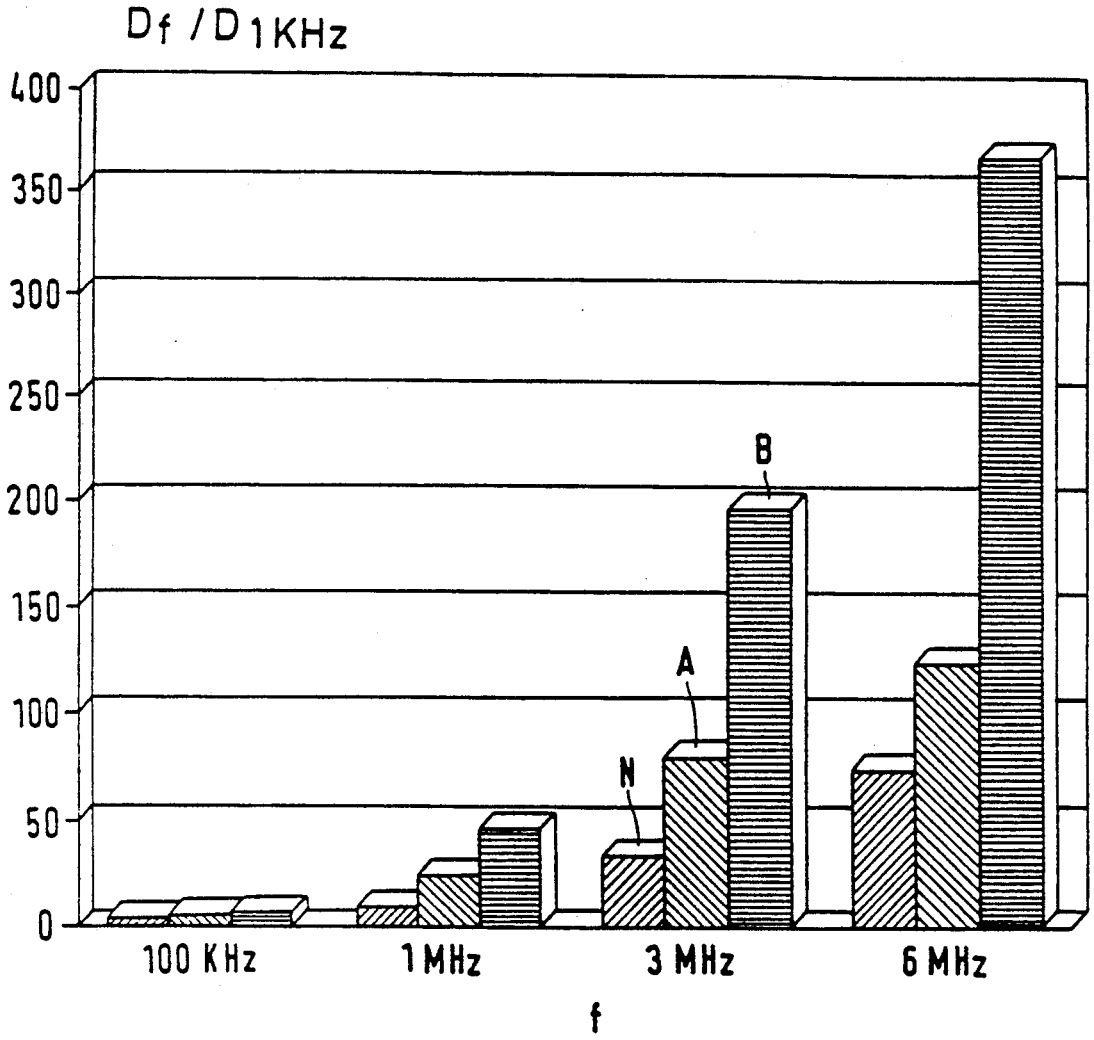
FIG. 4 is a view showing a relative increase of the cable damping with the frequency.

The behavior of the wandering waves in the X-ray cables is determined by the short circuit studies of cable samples. FIGS. 3 and 4 show the measurement results of three samples of the conduit type shown in FIG. 1 with following different constructions of the inner conductor:

N) (1+6)×0.11 mm copper

A) synthetic plastic core+6×(1+6)×0.15 mm Fe and

B) 1×0.2 mm Cu+6×0.2 mm Ni-Fe-alloy.

As can be seen from FIG. 3, the test sample at one cable end is connected through a protective resistance with the direct current source $U_\phi$, while at the other end it is short-circuited. The voltage course in this switching circuit is detected between the protective resistance and the sample and indicated on a digital storage oscilloscope. In FIG. 3 the time decay of the transient over voltage $U_\phi$ is graphically shown in ratio to applied voltage $U_\phi$ during short-circuiting. It can be easily seen that the inventive conduit samples A and B show stronger or significantly stronger damping of the transient over voltage than the conventional test sample N.

In this test samples the cable constants were measured in dependence on the frequency. With the aid of an impedance-analyzer the respective cable damping was determined. In FIG. 4 the relative increase of the conduit damping is shown for three test samples with reference to the damping value at the frequency of 1 KHz. It can be seen that the multiplication of the relative damping values during the conventional use of the copper wires (test sample N), at 3 MHz achieves only the factor 30 and with 6 MHz obtains only the factor 65. In contrast, with the use of the inventive iron wires (test sample A) it achieves the factor 70 or 120 and with the use of Ni-Fe-alloy wires (test sample B), the factor 190 or 360.

FIG. 5 shows a concentrically formed X-ray cable with two heating conductors. The cable shown in FIG. 5 has the central inner conductor (high voltage conductor) 1, the inner conducting sleeve 2, the high voltage insulation 3, the outer conducting sleeve which can be extruded or band shaped, the outer conductor 5, the outer casing 6 and a band 6' arranged under the outer casing 6.

The inner conductor includes a first heating conductor 10, an insulation 11, a second heating conductor 12, an insulation 13, and a high voltage conductor 14. In contrast in the embodiment of FIG. 1 there is no heating conductor, but instead only the high voltage conductor 1.

In the embodiment shown in FIG. 6 the inner conduct has a core which is provided with two heating conductors 8, 9 and one heat control conductor 15–16, surrounded by a conducting sleeve 17 and a concentric high voltage conductor 18. In the embodiment of FIG. 2 the core of the inner conductor has two high voltage conductors 7 and two heating conductors 8, 9 which are stranded with one another.

It will be understood that each of the elements described above, or two or more together, may also find a useful application in other types of constructions differing from the types described above.

While the invention has been illustrated and described as embodied in an X-ray conduit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An X-ray cable, comprising a plurality of elements arranged concentrically relative to one another and including from inside toward outside at least one inner conductor, an inner conducting sleeve, a high voltage insulation, an outer conducting sleeve, a screen and a casing, said inner conductor being composed of one or several wires each with a diameter between 0.1 and 0.6 mm, at least one of said wires being composed of ferromagnetic material with high permeability at frequencies over 1 MHz, and a direct current resistance of said inner conductor lies under 20 Ω/m, so that without the use of damping members, strongly increasing damping of occurring transient over voltages with a frequency of above 1 MHz is provided.

2. An X-ray cable as defined in claim 1 wherein said inner conductor is composed of several wires both with a diameter between 0.1 and 0.4 mm.

3. An X-ray cable as defined in claim 1, wherein said inner conductor consists of one wire with a diameter between 0.2 and 0.6 mm.

4. An X-ray cable as defined in claim 1, wherein said one of several wires of said inner conductor are composed of iron.

5. An X-ray cable as defined in claim 1, wherein said one or several wires or said inner conductor are composed of Ni-Fe-alloy, the multiplication factor of a damping value referred to 1 kHz is over 190 at 3 MHz and is over 360 at 6 MHz.

6. An X-ray cable as defined in claim 1, wherein said inner conductor is formed as a conductor core with several inner conductor members.

7. An X-ray cable as defined in claim 1, wherein all said wires of said inner conductor are composed of ferromagnetic material.

8. An X-ray cable as defined in claim 1, wherein the remaining ones of several wires of said inner conductor are composed of a material with higher electrical conductivity.

9. An X-ray cable as defined in claim 5, wherein said one or several wires are composed of said Ni-Fe-alloy with a composition of 75% Ni, 5% Cu, 2% Cr, 0.5% Mn, 0.2% Si, 0.02% C, with the remainder being iron.

10. An X-ray cable as defined in claim 1, wherein said one of several wires of said inner conductor include a core wire which is composed of a material selected from the group consisting of copper and silver, the remaining wires of said inner conductor being composed of a material selected from the group consisting of iron and Ni-Fe-alloy.

11. An X-ray cable as defined in claim 1, wherein said inner conductor has includes a core of a synthetic plastic string, and surrounding said synthetic plastic string a layer of 6 stranded elements each including a core wire and a layer of 6 wires, all 42 wires are formed as steel wires with a thickness of 0.15 mm and stranded.

12. An X-ray cable as defined in claim 1, wherein said inner conductor has a core of a wire composed of a material selected from the group consisting of copper and silver, and a layer of wires composed of a material selected from the group consisting of iron and Ni-Fe-alloy and stranded.

13. An X-ray cable as defined in claim 12, wherein said core has a copper wire with a thickness of 0.2 mm, and said layer has 6 wires of Ni-Fe-alloy with a thickness of 0.2 mm.

14. An X-ray cable as defined in claim 1, wherein said inner conductor has a core which is not provided with a heating conductor and includes a concentric high voltage conductor.

15. An X-ray cable as defined in claim 1, wherein said inner conductor has a core which includes a heating conductor, an insulation, and a high voltage conductor arranged from inside outwardly concentrically relative to one another.

16. An X-ray cable as defined in claim 1, wherein said inner conductor has a core including two high voltage conductors and two heating conductors stranded with on another.

17. An X-ray cable as defined in claim 1, wherein said inner conductor has a core including two heating conductors and one grid driving conductor stranded with one another and then a conducting sleeve and a concentric high voltage conductor around the same.

18. An X-ray cable as defined in claim 1, wherein said inner conductor is formed as a braid composed of wires.

19. An X-ray cable as defined in claim 18, wherein said are wires composed of a material selected from the group consisting of copper and silver.

20. An X-ray cable as defined in claim 1, wherein said inner conductor is formed as a strand composed of wires.

21. An X-ray cable as defined in claim 20, wherein said are wires composed of a material selected from the group consisting of copper and silver.

* * * * *